United States Patent [19]

Yamada

[11] 4,276,666

[45] Jul. 7, 1981

[54] MATTRESS

[75] Inventor: Junji Yamada, Nihonbashi

[73] Assignee: Yamada Co., Ltd., Melbourne Plaza, Hong Kong

[21] Appl. No.: 68,069

[22] Filed: Aug. 20, 1979

[30] Foreign Application Priority Data

Dec. 12, 1978 [JP] Japan ..... 53-153870

[51] Int. Cl.[3] ..... A47C 27/14; A47C 27/15

[52] U.S. Cl. ..... 5/481; 5/DIG. 2; 297/DIG. 1

[58] Field of Search ..... 5/DIG. 2, 448, 481, 5/431; 297/DIG. 1

[56] References Cited

U.S. PATENT DOCUMENTS

| | | | |
|---|---|---|---|
| 3,026,544 | 3/1962 | Persicke et al. | 5/DIG. 2 |
| 3,049,730 | 8/1962 | Wall et al. | 292/DIG. 1 |
| 3,070,402 | 12/1962 | Stanton | 297/DIG. 1 |
| 3,133,853 | 5/1964 | Knox | 297/DIG. 1 |
| 3,197,357 | 7/1965 | Schulpen | 5/481 |
| 3,222,697 | 12/1965 | Scheermesser | 5/481 |
| 3,258,791 | 7/1966 | Kaplan | 5/481 |
| 3,521,311 | 7/1970 | Cohen | 5/DIG. 2 |
| 3,939,508 | 2/1976 | Mall et al. | 5/464 |
| 4,064,578 | 12/1977 | Yamada | 5/481 |

*Primary Examiner*—Alexander Grosz

*Attorney, Agent, or Firm*—Oblon, Fisher, Spivak, McClelland & Maier

[57] ABSTRACT

A mattress is composed of a sponge like material which compresses by 65% of the thickness thereof under a load of 30 Kg per 314 $cm^2$. The mattress is treated so that it subsequently is compressed by 65% of the thickness thereof under a load of 25 Kg per 314 $cm^2$. The treatment consists of providing the upper surface of the mattress with a plurality of protuberances. The mattress may be composed of several layers of such material, each having such a plurality of protuberances on one surface. The mattress may be encased by elastic netting.

3 Claims, 10 Drawing Figures

MATTRESS

BACKGROUND OF THE INVENTION

1. Field of the Invention

This invention relates to a novel cushion, more particularly, to a sponge cushion for use as a mattress or a seat in a motor vehicle wherein the cushion is compressed about 65 percent in height by the weight of a person lying upon the pad.

2. Description of the Prior Art

In a sponge cushion for use as a mattress or a seat in a motor vehicle, heretofore, there has not been a sponge cushion considering the relation between the nature of the material thereof and the weight of a person lying upon the pad. Only a sponge cushion, which improved air circulation and provided a feeling of contact, has been used in replacement of a cotton cushion pad.

Ideally, a mattress cushion should, whether of cotton or sponge, possess characteristics wherein (a) when it is used, it will be able to deform so as to conform to an ideal lying position of a person, (b) it has a pleasant feeling upon skin contact, (c) it will not prevent the flow of blood in a body contact portion, (d) it is able to provide dispersion of water and heat emitted from a body lying upon the cushion, (e) it retains warmth very well, (f) a person lying upon the cushion does not feel contact with the floor lying under the cushion and (g) it has a good endurance.

The ideal lying position mentioned above means one similar to a position in which a person is standing naturally. The ideal lying position, as shown in FIG. 1 is arranged to extend horizontally from the center of the head (X) to the center of the sole of the foot (Y). This ideal lying position is in a form of an area of contact between the cushion and body at the back of the head, the back of the shoulder, the waist portion, the hip portion, an elbow, a thigh portion and the heel, and is in a form of a curve tying all of said points, in a plane of contact. This shape of the cushion does not prevent a flow of blood. Thus an ideal mattress cushion is one which may be deformed into the form of a said ideal curve when a downward force is exerted on the cushion by the weight of a person. The cushion, which may be deformed into the form of such a curve by the weight of a person results in no feeling of contact with the floor, good air circulation, a pleasant feeling of contact with the cushion and suitable warmth. When a person of a weight of 57 kg lies upon the mattress in a ideal lying position, the downward force is dispersed in the portions of the body as follows: in the back of the head 5 kg, the back of the shoulder 13.2 kg, elbows 2 kg×2=4 kg, the waist portion 5.7 kg, the hip portion 23 kg, thigh portions 4.8 kg×2=9.6 kg calves 4.6 kg×2=9.2 kg, heels 3.2 kg×2=6.4 kg.

SUMMARY OF THE INVENTION

The development of the shape and nature of a cushion required to support each portion of the weight of a body in an ideal lying position is one important point of this invention.

If the cushion is soft enough, the human body line sinks into the cushion as a V in which the bottom indicates the hip, while if the cushion is too hard, the body line appears as an inverted V since the hip on the cushion will upheave, and the head and the hip seat will be at the same level.

With further considering of an ideal lying position, I have found that it is desirable that the center of a head be positioned at the level of an upper surface of the cushion, the back of the head be positioned at lower level $\frac{2}{3}$ of the height of the cushion, and at that position, the hip portion be at a lower level $\frac{1}{3}$ of the height of the cushion when a person lies upon the cushion. Next I have found the area of contact of the hip portion to the upper surface of the cushion when the cushion is compressed about $\frac{2}{3}$ of the height thereof by the weight of the hip portion and have developed such material that it may be compressed about $\frac{2}{3}$ the height of the cushion by the weight of the hip portion. In this case, assuming that the weight of the hip concentrates at one point.

Since the downward forces exerted by the several portions of a body are different, I have found that the cushion must have a surface treated wavingly in response to the weights of each portion of a body. Also I have found the need to select a cushion which will not be compressed by more than $\frac{2}{3}$ of the height thereof by the weight of a body, to maintain the function of the cushion, since a cushion impairs it's function when it is compressed more than $\frac{2}{3}$ of its height, thereby preventing a feeling of contact with the floor lying under the cushion. So it is necessary to adapt such a sponge cushion so that it is not compressed more than $\frac{2}{3}$ of the height thereof by the weight of a person lying upon the cushion. Namely, (if a person e.g. 57 kg in a weight lies upon the cushion,) it is necessary to adapt a sponge cushion to be compressed about 65% of the height thereof by the weight of the hip portion 23 kg. Then, it is apparent that commercial urethane foam can't be used since it is compressed 65% of the height thereof by the weight of 21.3 kg and is compressed more than 65% of the height thereof by the weight of 23 kg, to give a person a feeling of contact with the floor lying under the cushion. I have found that the aim of causing the cushion to be compressed about 65% of the height thereof by the weight of its user is accomplished by using a sponge i.e. urethane foam. Further, I have found that the mattress which is attained can greatly retain warmth, more easily absorb water emitted from a person lying thereupon and does not prevent the flow of blood in the contact portion of a body lying thereupon by providing conical protuberances in a top surface of the mattress. Still further, the same advantages are attained by piling up layers of sponges providing such protuberances in their top surface.

In addition to said advantages, the mattress' endurance is increased by wrapping it with an elastic net.

BRIEF DESCRIPTION OF THE DRAWINGS

Various other objects, features and attendant advantages of the present invention will be more fully appreciated as the same becomes better understood from the following detailed description when considered in connection with the accompanying wherein like reference characters designate like or corresponding parts throughout the several views, and wherein.

DETAILED DESCRIPTION OF THE PREFERRED EMBODIMENTS

Figure 1:
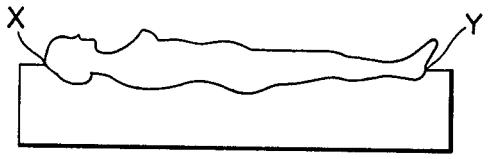
FIG. 1 is a vertical section of the ideal lying position.
Figure 2:
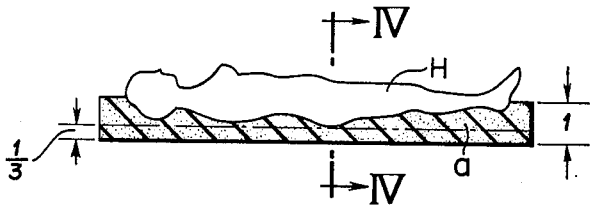
FIG. 2 is a vertical section of mattress shown in FIG. 1.
Figure 3:
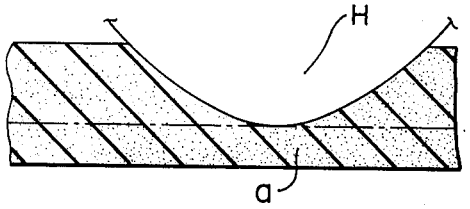
FIG. 3 is an enlarged fragmentary view of the mattress of FIG. 1.
Figure 4:
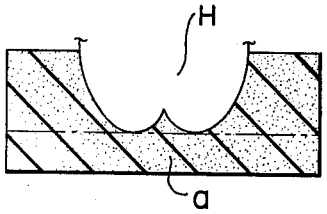
FIG. 4 is a vertical sectional view taken along the line IV—IV in FIG. 2.

In an embodiment shown in FIG. 2 to FIG. 4, a sponge (a) is arranged to be compressed ⅔, or about 65% of the height of the sponge (a), in that portion of the sponge corresponding to the hip portion, the location of the greatest load of a body, when a body lies upon the sponge (a).

Figure 5:
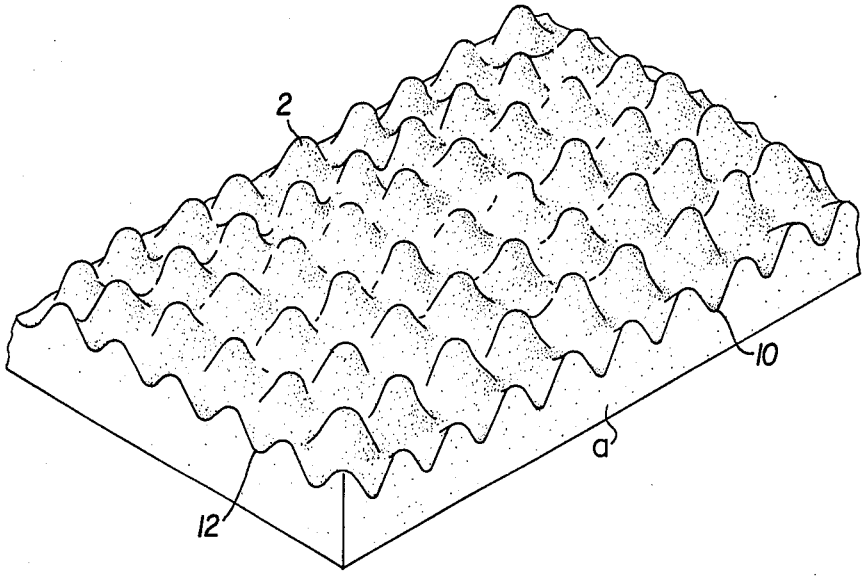
FIGS. 5 and 6 are views of the mattress including protuberances.
Figure 6:
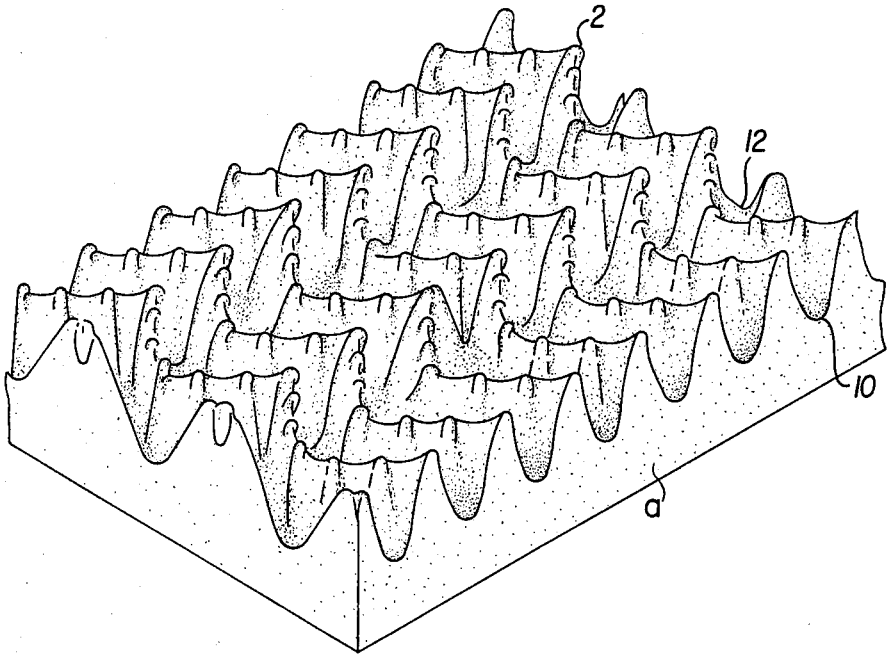

In the embodiment shown in FIG. 5 and FIG. 6, the sponge (a) is provided with the protuberances 2 on its top surface and arranged to be compressed about 65% of the height thereof by the weight of a body lying thereupon. The protuberances are conical shaped in FIG. 5 and ridge shaped in FIG. 6. The ratio of a flat surface area to a surface area provided with many protuberances is 1:1.7. Namely, it is apparent that the surface of an area provided with many protuberances is greater than a flat surface and is better in heat conductivity and water adsorbing capacity. The smaller a surface area of contact between a mattress and a person lying thereupon, the more desirable for a person's health, since this results in a greater non-pressurized portion of a person's body by a mattress.

A portion of a body contacting a mattress tends to become impaired. A long period of lying upon a mattress tends to cause bedsore even though it is less than the pressure necessary to cause an impediment of blood flow (200 or 100 g/cm$^2$).

On the other hand, when the weight of a person is supported by a smaller area of a mattress, the load per a unit area increases to cause an impediment of blood flow.

To reach a meeting point of both of the above, it is desirable that a maximum load exerted on a mattress not be more than 100 g/cm$^2$ and an area of contact with a mattress is minimum when a person lies upon a mattress. A mattress in FIG. 7 to FIG. 10 comprises a plurality of layers of sponge which are compressed about 65% of the height thereof by the weight of a person lying thereupon, each layer of sponge having many protuberances on it's top surface.

Figure 7:
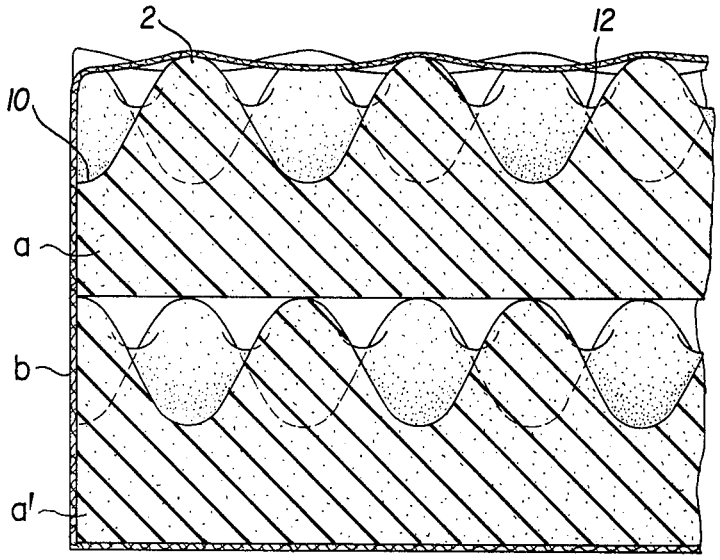
FIG. 7 to FIG. 10 are enlarged fragmentary views showing embodiments made up of layers of sponges.

In FIG. 7, there is provided two layers of sponge comprising an upper sponge layer (a) and a lower sponge layer (a') each having many protuberances on its top surface and being of the same thickness.

The layers in FIG. 7 are such that they are compressed about ⅔ of the total thickness of the two layers of sponge by the weight of the hip portion of a person lying thereupon.

Further the embodiment of FIG. 7 is arranged that each protuberance of a lower layer of sponge (a') is positioned under each cavity of an upper layer of sponge (a).

Thus, a load exerted on an upper layer is dispersed from a protuberance of an upper layer into an upper layer sponge and from a protuberance of a lower layer sponge into a lower layer sponge.

Due to the fact that elastic repulsion of two layers of sponge is less than one layer of sponge, a person is more comfortable during use of the mattress.

In addition, sweat from a person using the mattress can be discharged outwardly from spaces formed between an upper layer and a lower layer of sponge.

Figure 8:
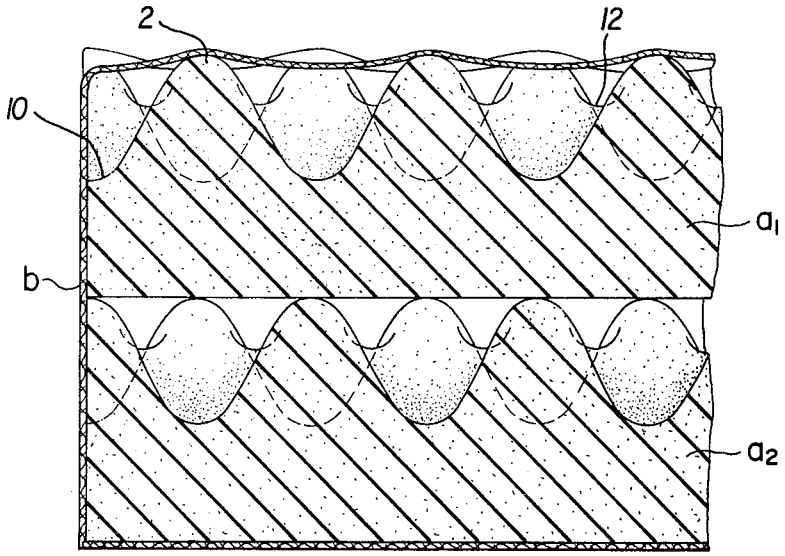

In FIG. 8, two layers of sponge comprise an upper soft layer ($a_1$) and a hard lower layer of sponge ($a_2$) piled up one above the other in a manner described in FIG. 7 and formed so as to be compressed about ⅔ of the total thickness of two layers by the weight of the hip portion of a person lying upon the sponge. Due to such a construction, it has a soft feeling of contact and there is no feeling of direct contact with the floor lying under the sponge. In addition, it has the advantages discussed in relation to FIG. 7.

Figure 9:
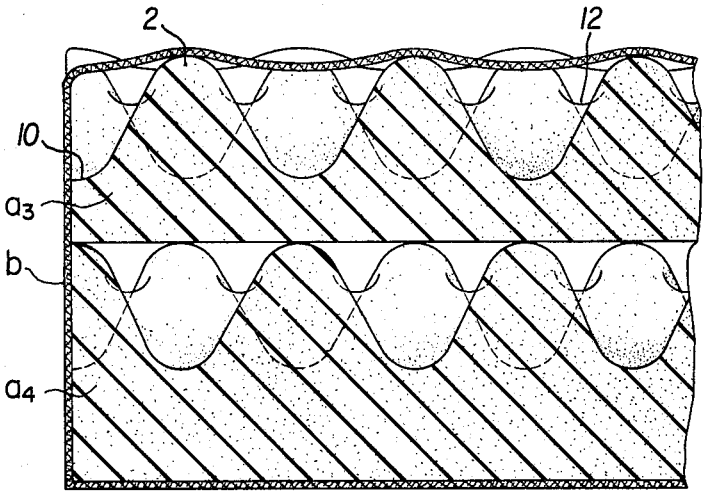

In FIG. 9, the sponge mattress comprises a thinner upper layer ($a_3$) and a thicker lower layer of sponge ($a_4$) piled up one above the other and is formed so as to be compressed about ⅔ of the total thickness of two layers by the weight of the hip portion. Such construction results in advantages similar to that in FIG. 7 and FIG. 8.

Conversely, two layers of sponge comprising a thicker upper layer and a thinner lower layer also result in advantages similar to those mentioned above.

Figure 10:
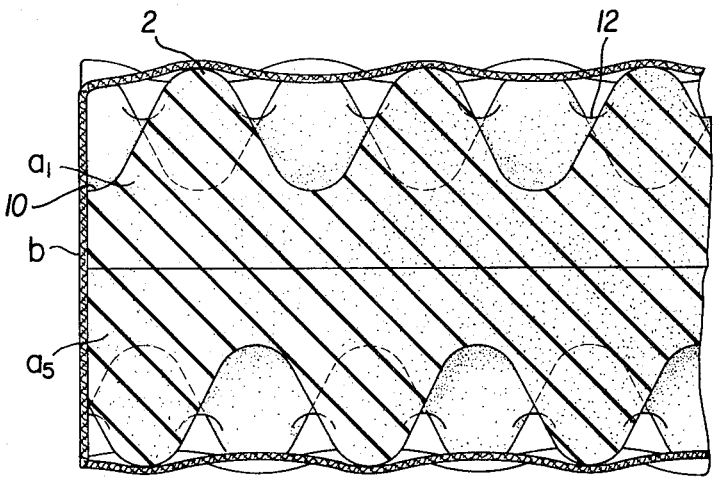

In FIG. 10, a mattress of two layers of sponge piled one upon the other comprises an upper layer ($a_1$) having many protuberances in its top surface and a lower layer ($a_5$) having many protuberances in its bottom surface and is formed so that it is compressed about ⅔ thereof by the weight of a hip portion of a person lying thereupon. With such construction, heat and water emitted from a person lying upon the mattress are dispersed outwardly without being deposited to the floor thereunder, thereby keeping it clean.

One aspect of this invention relates to, in a sponge normally being compressed about 65% thereof by a load of 30 kg/314 cm$^2$ and having specific gravity of 0.035, the sponge mattress being surface treated so as to be compressed about 65% thereof by a load of 25 kg/314 cm$^2$.

According to the invention, a flat sponge having a standard specific gravity (g/cm$^2$) of 0.035 and which can be originally compressed about 65% the thickness thereof by the load of about 30 kg per 314 cm$^2$ is used. That is, the sponge is unevenly surface-treated so that it can subsequently be compressed about 65% the thickness thereof by a 25 Kg load per 314 cm$^2$ which is an average hip weight. A comparison of the physical properties of the sponge prior to the surface treatment, with those of conventional polyether urethane foam is as follows:

TABLE 1

COMPARISON OF PHYSICAL PROPERTIES

| ITEM | UNIT | CONVENTIONAL POLYETHER URETHANE FOAM | SPONGE OF PRESENT INVENTION |
|---|---|---|---|
| Density | g/cm$^3$ | 0.0178 | 0.035 |
| Elastic Repulsion | % | 43 | 49 |
| Pressure for 25% Compression | Kg/314 cm$^2$ | 9.2 | 15.2 |
| Pressure for 65% Compression | Kg/314 cm$^2$ | 18.0 | 29.6 |
| Cell Number | Pcs/25 mm | 37 | 38 |
| Tensile Strength | kg/cm$^2$ | 1.07 | 1.07 |

TABLE 1-continued

| COMPARISON OF PHYSICAL PROPERTIES | | | |
|---|---|---|---|
| ITEM | UNIT | CONVENTIONAL POLYETHER URETHANE FOAM | SPONGE OF PRESENT INVENTION |
| Elongation | % | 190 | 146 |
| Tear Strength | $Kg/cm^2$ | 0.67 | 0.61 |
| 50% Residual Distortion | % | 6.7 | 1.5 |
| Residual Distortion due to Repeated Compression | % | 4.9 | 1.1 |
| Residual Distortion due to Compression (80%) | % | 8.2 | 3.0 |
| Residual Distortion due to Compression (90%) | % | 10.6 | 3.7 |

As is clear from the Table 1, above, a sponge with physical properties superior to a conventional sponge, is used according to the invention. The sponge is unevenly surface-treated such that it is provided with deep grooves 10 of 35 mm in depth in its cross direction and shallow grooves 12 of 20 mm in depth in its diagonal direction, in order that the hip of a person lying on the sponge sinks 65% the thickness thereof.

Another aspect of this invention relates to a mattress in which sponge having a specific gravity of 0.02–0.04 is surface treated so that it is compressed about 65% thereof by the weight of a person lying thereupon.

Such a mattress is mainly used as a cushion and seat for a motor vehicle. In this case, almost all the weight of a seated person is exerted onto a portion thereof that contacts the hip portion of the user. When the user is seated, the mattress is formed so that it is compressed about 65% of the thickness of the sponge by having the specific gravity of the sponge of this mattress at 0.02 to 0.04 and provided at all its surface with many protuberances.

The shape of these protuberances is similar to that of FIG. 5.

There is also provided a process for producing a low density polyurethane foam of flexible or semi-flexible properties, the process comprising mixing (A) polyether and polyal containing 2 through 4 hydroxy groups and having a molecular weight of about 1,000–10,000, (B) organic polyisocianate and, (C) foaming agent containing water, with (D) a surfactant and (E) a tertiary amine catalyst, in such a manner that the molar ratio of —NCO and active hydrogen is 0.70:1–1.35:1, and then reacting them by a single stage process or prepolymer process. As a result, formed polyurethane foam is prepared by adding to said mixture, (I) halogen containing minutely-broken solid polymer resin in a ratio of about 2–100 parts by weight per 100 parts by weight of said polyol; (II) 0.5–15 parts by weight of zinc oxide (obtained by French method) per 100 parts by weight of said polyol and; (III) about 1–20 parts by weight of antimony oxide per 100 parts by weight of said polyol; and in that said polyurethane foam is unevenly surface treated so that the mattress obtained from said foam can be compressed about 65% the thickness thereof by the weight of a person lying thereon.

The polyurethane foam is produced as follows. At the first stage, 30 parts by weight of $Hx=H_3x$ and 30 parts by weight of $Hx=H_6x$ are blended with each other. To this mixture, there are mixed 10 parts by weight of polyvinyl chloride, antimony trioxide ($Sb_2O_3$) and zinc oxide (ZnO), and 40 parts by weight of $Hx=H_3x$. In addition, 40–50 parts by weight of isocianate, $H_2O$ and tertiary amine, and 3.3 parts by weight of silicon foaming agent and 0.2–0.3 parts by weight of tin catalyst are mixed into the mixture. The obtained mixture is foamed, hardened and shaped and, thus, the desired polyurethane foam is obtained. A comparison of physical property between the foam of the present invention and the marketed product, is shown below:

TABLE 2

| | Polyurethane of this invention | Marketed good |
|---|---|---|
| (1) Simulate Specific Gravity (ASTM) | 0.035 $g/cm^3$ | 0.0307 $g/cm^3$ |
| (2) Hardness (JIS $50^m/_m t$) | | |
| load when deflected 25% | 15.0 $Kg/314cm^2$ | 13.5 $Kg/314cm^2$ |
| load when deflected 65% | 32.0 $Kg/314cm^2$ | 26.4 $Kg/314cm^2$ |
| (3) Unit Tensile Strength (JIS) | 1.10 $Kg/cm^2$ | 0.86 $Kg/cm^2$ |
| (4) Elongation (JIS) | 170% | 150% |
| (5) Tear Strength (ASTM) | 0.65 $Kg/cm^2$ | 0.57 $Kg/cm^2$ |
| (6) Elastic Repulsion (JIS) | 48% | 44% |
| (7) Residual Distortion due to Compression (JIS) | 1.8% | 2.7% |
| (8) Residual Distortion due to Repeated Compression (JIS) | 1.2% | 2.0% |
| (9) Combustion Test (ASTM) | Self Extinction (SE) | Self Extinction (SE) |
| Endurance Test against the Combustion made for three months at 80° C. | Self Extinction (SE) | Combustibility (B) |

The polyurethane mentioned above provides it's top surface with the same many protuberances as those of this invention so that it is compressed about 65% the thickness thereof by the weight of a person, e.g. of the hip portion when it is used as mattress. The table below compares the mattress of this invention and a marketed mattress as to compression, load and measured deflection data (according to Test method JISK 6401).

TABLE 3

| | Load when deflected 25% | Load when deflected 50% | Load when deflected 65% | Load when deflected 75% |
|---|---|---|---|---|
| Mattress in this invention (70 mm, profile) | 10.4 | 20.5 | 28.3 | 44.5 |
| Marketed mattress (80 mm, profile) | 9.5 | 17.1 | 21.8 | 30.5 |

The pressed plate for measuring the load was pressed from the profiled surface (25%—50%—65%—75%) in practical use.

TABLE 4

Results of an endurance test (after being pressed repeatedly 250,000 times)

| | sample | | | |
|---|---|---|---|---|
| | Marketed goods | | This invention | |
| | condition | | | |
| Articles | before E.T. | after E.T. | before E.T. | after E.T. |
| Thickness mm | 77.0 | 74.8 | 84.3 | 82.9 |
| Yield ratio % | | 2.8 | | 1.7 |
| 25% hardness Kg/314cm$^2$ | 7.3 | 4.8 | 8.0 | 6.1 |
| Fall ratio % | | 34.2 | | 23.9 |
| 65% hardness Kg/314cm$^2$ | 21.3 | 14.9 | 24.0 | 22.0 |
| Fall ratio % | | 30.0 | | 8.4 |

Table 4 shows that the mattress of the present invention increases the value of stress to deflection as deflection increases with almost no change in initial load stage, and provides no feeling of falling or feeling of contact with the floor thereunder and has good endurance.

Still another aspect of this invention relates to a mattress in which a sponge being compressed about 65% thereof by the weight of a person lying thereupon and having many protuberances as it's upper surface, is covered with an elastic net casing. The net casing is provided by knitting thread such as synthetic fiber into four courses of dia mesh (a course/16 inch) (FIG. 7). This net casing (b) may be coloured, such as blue, to conceal soiling of the mattress due to a long period of use. Since this net casing conforms to the surface portion of a sponge compressed by a person lying thereupon, the functional advantage of providing the mattress top surface with many protuberances is not impaired. The sponge mattress provided at it's top surface with many protuberances causes a pump action to occur due to up and down motion in use, to thereby easily release outwardly the water from the body and disperse the pressure of the body so as not to press the blood vessel in a part pressed, to thereby prevent a bedsore. As a pressed part and a non-pressed part lie close together, a pressed part can be moved to a non-pressed position by a small movement of the body to thereby disperse the pressure on the body and prevent a lengthy application of pressure to a portion of the body. This invention therefore provides a mattress which prevents damage and change in the protuberances, and has endurance.

The mattress of this invention comprises a sponge being compressed about 65% the thickness thereof by the weight of a person lying thereupon, thereby to possess both a preferable hardness and softness and no feeling of contact with a floor, while not preventing a flow of blood. The difference of position in a back and a hip portion when lying down is smaller than that in standing position, so the mattress has a desirable hardness for a person to lie thereupon.

The mattress of this invention comprises a sponge providing at it's top surface with many protuberances and being compressed about 65% the thickness thereof by the weight of a person lying thereupon. In addition, due to more surface area than that of a flat surface it has better heat conduction and good hygroscopic nature, and easily disperses outwardly heat and water emitted from a body. Further, it does not prevent a flow of blood and prevents bedsores since the contact area of a person and mattress is small due to the many protuberances.

According to the invention, as discussed above, there is provided a process for producing a low density polyurethane foam of flexible or semi-flexible property. The method comprises mixing (A) polyether and polyol containing 2 through 4 hydroxy groups and having a molecular weight of about 1,000–10,000; (B) organic polyisocianate and; (C) foaming agent containing water; with (D) a surfactant and; (E) tertiary amine catalyst, in such a manner that the molar ratio of —NCO and active hydrogen rest is 0.70:1–1.35:1, and then reacting them by a single stage process or prepolymer process. The formed polyurethane foam is further prepared by adding to said mixture, (I) halogen containing and minutely-broken solid polymer resin in a ratio of about 2–100 parts by weight per 100 parts by weight of said polyol; (II) 0.5–15 parts by weight of zinc oxide (obtained by French method) per 100 parts by weight of said polyol and; (III) about 1–20 parts by weight of antimony oxide per 100 parts by weight of said polyol. The polyurethane foam is unevenly surface treated so that the mattress obtained from said foam can be compressed about 65% the thickness thereof by the weight of a person lying thereon.

Therefore, the mattress of the present invention exhibits high deforming or bending stress as the sleeper sinks into the mattress and, thus, he feels no bottom touch, that is, he feels extremely comfortable. Further, it endures well for a long time.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A mattress comprising a sponge having a specific gravity of 0.035 and being compressed about 65% of the thickness thereof by the load of 30 Kg per 314 cm$^2$, wherein said sponge is provided with surface protruberances so that it can be compressed about 65% the thickness thereof by a load of 25 Kg per 314 cm$^2$, whereby a person weighing 57 kg, when lying on the mattress, does not feel the ground below said mattress.

2. A mattress of claim 1, further comprising at least two layers of sponge piled one upon the other.

3. The mattress of claim 2 in which said sponge is covered with an elastic net casing.

* * * * *